US009366107B2

(12) United States Patent
Hallundbæk et al.

(10) Patent No.: US 9,366,107 B2
(45) Date of Patent: Jun. 14, 2016

(54) ANNULAR BARRIER WITH AN EXPANSION DETECTION DEVICE

(71) Applicant: WELLTEC A/S, Allerød (DK)

(72) Inventors: Jørgen Hallundbæk, Græsted (DK); Paul Hazel, Aberdeen (GB)

(73) Assignee: WELLTEC A/S, Allerød (DK)

( * ) Notice: Subject to any disclaimer, the term of this patent is extended or adjusted under 35 U.S.C. 154(b) by 122 days.

(21) Appl. No.: 14/362,906

(22) PCT Filed: Dec. 20, 2012

(86) PCT No.: PCT/EP2012/076285

§ 371 (c)(1),
(2) Date: Jun. 4, 2014

(87) PCT Pub. No.: WO2013/092801

PCT Pub. Date: Jun. 7, 2013

(65) Prior Publication Data

US 2014/0332232 A1 Nov. 13, 2014

(30) Foreign Application Priority Data

Dec. 21, 2011 (EP) ..... 11194957

(51) Int. Cl.
*E21B 33/127* (2006.01)
*E21B 33/124* (2006.01)
(Continued)

(52) U.S. Cl.
CPC ..... *E21B 33/1277* (2013.01); *E21B 33/10* (2013.01); *E21B 33/1243* (2013.01); *E21B 34/066* (2013.01); *E21B 34/12* (2013.01); *E21B 47/08* (2013.01)

(58) Field of Classification Search
CPC ..... E21B 34/066; E21B 33/1243; E21B 33/1277; E21B 33/127; E21B 47/09; E21B 47/08; E21B 47/00
See application file for complete search history.

(56) References Cited

U.S. PATENT DOCUMENTS 3,926,254 A * 12/1975 Evans ..... E21B 33/1272 166/106
4,230,180 A * 10/1980 Patton ..... E21B 33/124 166/100

(Continued)

FOREIGN PATENT DOCUMENTS

EP 0 566 290 10/1993
GB 2 079 819 1/1982

OTHER PUBLICATIONS

International Preliminary Report on Patentability mailed Jul. 3, 2014 in International Application No. PCT/EP2012/076285 (8 pages).

(Continued)

*Primary Examiner* — Shane Bomar
(74) *Attorney, Agent, or Firm* — Nixon & Vanderhye P.C.

(57) ABSTRACT

The present invention relates to an annular barrier (1) to be expanded in an annulus (2) between a well tubular structure and an inside wall (4) of a borehole (5) downhole, comprising a tubular part for mounting as part of the well tubular structure, said tubular part (6) having a longitudinal axis; an expandable sleeve (7) surrounding the tubular part and having an outer face (8), each end (9, 10) of the expandable sleeve being fastened to the tubular part by means of a connection part (12), where one of the connection parts is a sliding connection part sliding in relation to the tubular part when the expandable sleeve is expanded; an annular barrier space (13) between the tubular part and the expandable sleeve; an aperture (11) in the tubular part for letting fluid into the annular barrier space to expand the sleeve; and an activatable shut-off valve (14) having an open and a closed position and arranged in the aperture, wherein the annular barrier further comprises a detection device (20) for detecting when the expandable sleeve has been expanded into a contact position, and wherein the detection device is adapted to provide a signal to activate the shut-off valve to bring the shut-off valve from the open to the closed position when detecting that the expandable sleeve is in the contact position. Furthermore, the invention relates to a downhole system comprising a plurality of annular barriers according to the invention and to a method for expanding an annular barrier.

15 Claims, 5 Drawing Sheets

(51) Int. Cl.

| | |
|---|---|
| ***E21B 34/06*** | (2006.01) |
| ***E21B 47/08*** | (2012.01) |
| ***E21B 33/10*** | (2006.01) |
| ***E21B 34/12*** | (2006.01) |

(56) References Cited

U.S. PATENT DOCUMENTS

| | | | | |
|---|---|---|---|---|
| 4,869,110 | A * | 9/1989 | Kent | G01B 11/16 73/1.15 |
| 4,899,320 | A | 2/1990 | Hearn et al. | |
| 5,291,947 | A * | 3/1994 | Stracke | E21B 33/1243 166/187 |
| 5,353,637 | A | 10/1994 | Plumb et al. | |
| 5,778,982 | A | 7/1998 | Hauck et al. | |
| 6,050,131 | A * | 4/2000 | Willauer | E21B 33/127 166/250.01 |
| 6,286,603 | B1 * | 9/2001 | Parent | E21B 33/1208 166/187 |
| 7,216,706 | B2 * | 5/2007 | Echols | E21B 33/12 166/177.1 |
| 8,091,634 | B2 * | 1/2012 | Corre | E21B 49/10 166/100 |
| 9,175,549 | B2 * | 11/2015 | Paturu | E21B 33/06 |
| 2003/0196820 | A1 | 10/2003 | Patel | |
| 2004/0173363 | A1 * | 9/2004 | Navarro-Sorroche | E21B 47/06 166/387 |
| 2009/0230104 | A1 * | 9/2009 | Domec | B23K 9/0282 219/121.78 |
| 2010/0122812 | A1 | 5/2010 | Corre et al. | |
| 2011/0266004 | A1 * | 11/2011 | Hallundbaek | E21B 33/1208 166/369 |

OTHER PUBLICATIONS

International Search Report for PCT/EP2012/076285, mailed Jan. 30, 2013.

Written Opinion of the International Searching Authority for PCT/EP2012/076285, mailed Jan. 30, 2013.

* cited by examiner

ANNULAR BARRIER WITH AN EXPANSION DETECTION DEVICE

This application is the U.S. national phase of International Application No. PCT/EP2012/076285, filed on 20 Dec. 2012, which designated the U.S. and claims priority to EP Application No. 11194957.4, filed on 21 Dec. 2011, the entire contents of each of which are hereby incorporated by reference.

FIELD OF THE INVENTION

The present invention relates to an annular barrier to be expanded in an annulus between a well tubular structure and an inside wall of a borehole downhole. Furthermore, the invention relates to a downhole system comprising a plurality of annular barriers according to the invention and to a method for expanding an annular barrier.

BACKGROUND ART

In wellbores, annular barriers are used for different purposes, such as for providing a barrier to flow between an inner tubular structure and the inner wall of the borehole. The annular barriers are mounted as part of the well tubular structure. An annular barrier has an inner wall surrounded by an annular expandable sleeve. The expandable sleeve is typically made of a metallic material, but may also be made of an elastomeric material. The sleeve is fastened at its ends to the inner wall of the annular barrier.

In order to seal off a zone between a well tubular structure and the borehole, a second annular barrier is used. The first annular barrier is expanded at one side of the zone to be sealed off and the second annular barrier is expanded at the other side of that zone. Thus, the entire zone is sealed off.

The pressure envelope of a well is governed by the burst rating of the tubular and the well hardware etc. used within the well construction. In some circumstances, the expandable sleeve of an annular barrier is expanded by increasing the pressure within the tubular structure of the well, which is the most cost-efficient way of expanding the sleeve.

When expanding the expandable sleeve of an annular barrier by pressurising the tubular structure from within, several annular barriers are expanded simultaneously. The force, i.e. pressure, required to expand the annular barriers depends on many variables, such as the size of the borehole in relation to the size of the inner tubular structure, the strength of the expansion sleeve, etc. As the size of the borehole may vary along the length of the well, the distance between the inner tubular structure and the inner wall of the borehole is not constant in the well. Consequently, different annular barriers require different pressure levels to be expanded into a contact position. However, if an annular barrier, after having been expanded into a contact position, is subject to an increasing pressure level in the well, undesirable damage of the surrounding formation or other adverse effects may be the result. An undesirable increase in the pressure in the expandable sleeve may result in a too high contact pressure between the expandable sleeve and the inner wall of the borehole, whereby the surrounding formation may crack and thereby compromise the seal effect of the annular barrier. Also, the expandable sleeve may crack or burst due to the increased pressure, thereby adversely affecting the effect of the annular barrier.

SUMMARY OF THE INVENTION

It is an object of the present invention to wholly or partly overcome the above disadvantages and drawbacks of the prior art. More specifically, it is an object to provide an improved annular barrier, wherein the pressure inside the expandable sleeve and/or the contact pressure between the expandable sleeve and the inner wall of the borehole are/is controllable.

The above objects, together with numerous other objects, advantages, and features, which will become evident from the below description, are accomplished by a solution in accordance with the present invention by an annular barrier to be expanded in an annulus between a well tubular structure and an inside wall of a borehole downhole, comprising:

- a tubular part for mounting as part of the well tubular structure, said tubular part having a longitudinal axis,
- an expandable sleeve surrounding the tubular part and having an outer face, each end of the expandable sleeve being fastened to the tubular part by means of a connection part, where one of the connection parts is a sliding connection part sliding in relation to the tubular part when the expandable sleeve is expanded,
- an annular barrier space between the tubular part and the expandable sleeve,
- an aperture in the tubular part for letting fluid into the annular barrier space to expand the sleeve, and
- a shut-off valve having an open and a closed position and arranged in the aperture, wherein the annular barrier further comprises a detection device for detecting when the expandable sleeve has been expanded into contact with the borehole and a contact force is within a predetermined vale, and wherein the detection device is adapted to provide a signal to activate the shut-off valve to bring the shut-off valve from the open to the closed position when detecting that the expandable sleeve is in the contact position.

In one embodiment, the shut-off valve may be an activatable shut-off valve.

By detecting when the expandable sleeve has been expanded into a contact position, being the position in which the expandable sleeve has been expanded into contact with the borehole and a contact force is within a predetermined interval, the shut-off valve may be activated to control the pressure inside the expandable sleeve. Hereby, it may be avoided that all annular barriers are equally expanded, and the risk of damaging the formation opposite one annular barrier not having to be expanded as much as another annular barrier may also be reduced substantially.

Thus, by the present invention, an improved annular barrier is achieved, wherein the pressure inside the expandable sleeve is controllable and/or wherein the contact pressure between the expandable sleeve and the inner wall of the borehole is controllable. Also, during expansion, information can be recorded and made available at surface. Hereby, it is obtained that the annular barrier is capable of operating autonomously.

The annular barrier may also comprise devices to confirm that a seal between the expandable sleeve and the borehole has been achieved, as described below, which also provides the ability for data to be recorded and made available at surface for interpretation.

In one embodiment, the detection device may comprise a movement sensor for detecting movement of the sliding connection part, and the detection device may be adapted to provide a signal to activate the shut-off valve to bring the shut-off valve from the open to the closed position when the movement sensor detects that the sliding connection part has stopped.

By detecting whether the sliding connection part first moves and then stops, and thus whether material expansion of the expandable sleeve is taking place, it may be possible to determine if the expandable sleeve has been expanded into a contact position in order to close the shut-off valve to control the pressure inside the expandable sleeve.

In another embodiment, the movement sensor may comprise a linear potentiometer for detecting a change in the position of the sliding connection part.

Also, the linear potentiometer may be a linear membrane potentiometer.

In yet another embodiment, the detection device may comprise an expansion sensor for detecting a material expansion of the expandable sleeve, wherein the detection device may be adapted to provide a signal to activate the shut-off valve to bring the shut-off valve from the open to the closed position when the expansion sensor detects that the material expansion of the expandable sleeve has stopped.

Moreover, the expansion sensor may comprise a strain gauge for detecting expansion of the material of the expandable sleeve.

Furthermore, the sensor may be an accelerometer or an infrared sensor for detecting fluid movement between the outer face of the expandable sleeve and the formation. The purpose of this is to confirm that the annular barrier has created the seal against the borehole wall.

Said sensors may be arranged on the outer face of the expandable sleeve.

In one embodiment, the activatable shut-off valve may be a solenoid valve adapted to block the flow of fluid into the annular barrier space when power to the soleniod valve is discontinued.

In another embodiment, the detection device may comprise a contact pressure sensor provided at the outer surface of the expandable sleeve, the pressure sensor being adapted to measure a contact force between the outer surface of the expandable sleeve and an inner wall of the borehole.

Said detection device may comprise a fluid pressure sensor for measuring the fluid pressure inside the annular barrier space.

The detection device may further comprise a distance sensor for measuring a change in a maximum inner diameter of the expandable sleeve.

Furthermore, the shut-off valve may be activated when the contact pressure between the outer surface of the expandable sleeve and the inner wall of the borehole is within a predetermined range, e.g. between 1,000 psi (69 bar)-2,000 psi (138 bar).

Moreover, the detection device may comprise a timer for closing the shut-off valve after a predetermined period of time subsequent to the detection of the expandable sleeve being in the contact position.

Said shut-off valve may be activated when the contact pressure between the outer surface of the expandable sleeve and the inner wall of the borehole is in the range of 1,000 psi (69 bar)-2,000 psi (138 bar).

Furthermore, the movement sensor may be a magnet sensor, an accelerometer, an infrared sensor, a variable reluctance sensors or an inductive magnetic sensor for detecting movement of the detecting movement of the sliding connection part.

Said magnet sensor or inductive magnet sensor may sense a plurality of magnets incorporated in the outer surface of the tubular part.

Moreover, the movement sensor may comprise a tracking wheel driving on the outer surface of the tubular part, thereby detecting movement of the sliding connection part.

Further, the expandable sleeve may be made of metal.

The invention also relates to a downhole system comprising a plurality of annular barriers according to the invention.

Finally, the present invention relates to a method for expanding an annular barrier according to the invention, comprising the steps of:

- positioning the annular barrier downhole as part of a well tubular structure,
- pressurising the tubular structure from within to expand the expandable sleeve of the annular barrier, and
- detecting when the expandable sleeve has been expanded into a contact position.

In one embodiment, the movement of the sliding connection part may be detected to determine when the expandable sleeve has been expanded into a contact position.

In another embodiment, the material expansion of the expandable sleeve may be detected to determine when the expandable sleeve has been expanded into a contact position.

In yet another embodiment, a change in an inner diameter of the expandable sleeve may be detected to determine when the expandable sleeve has been expanded into a contact position.

Furthermore, the method as described above may comprise the step of activating the shut-off valve to block the flow of fluid into the annular barrier space when the expandable sleeve has been expanded into a contact position.

In said method, a contact pressure between the outer surface of the expandable sleeve and the inner wall of the borehole may be measured to detect when the expandable sleeve has been expanded into a contact position, Moreover, the shut-off valve may be activated when the contact pressure between the outer surface of the expandable sleeve and the inner wall of the borehole is in the range of 1,000 psi (69 bar)-2,000 psi (138 bar).

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
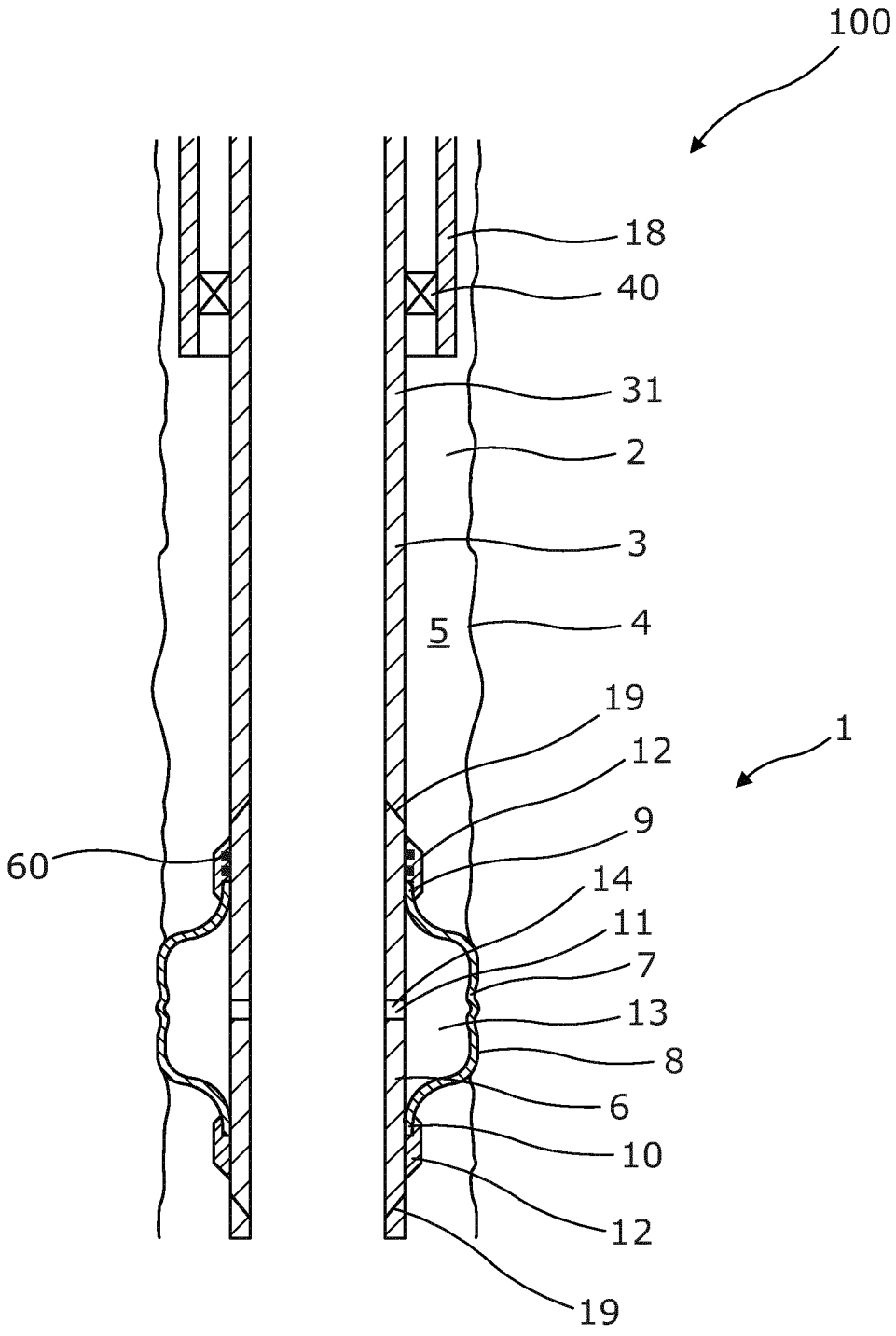
FIG. 1 shows an annular barrier being part of a well tubular structure in an expanded condition of the annular barrier.

FIG. 1 shows an annular barrier 1 expanded in an annulus 2 between a well tubular structure 3 and an inside wall 4 of a borehole 5 downhole. The annular barrier 1 comprises a tubular part 6 which has been mounted as part of the well tubular structure 3 by means of a threaded connection 19. The annular barrier 1 comprises an expandable sleeve 7 surrounding the tubular part 6 and having an outer face 8 which, in an expanded condition of the annular barrier 1, abuts the inside wall 4 of the borehole 5. Each end 9, 10 of the expandable sleeve 7 is fastened to the tubular part 6 by means of a connection part 12. The expandable sleeve 7 surrounds the tubular part 6, forming an annular barrier space 13 there between. An aperture 11 is arranged in the tubular part 6 through which fluid is let into the space 13 to expand the sleeve 7. When expanding the expandable sleeve 7, the well tubular structure 3 is pressurised with fluid from the top of the well, and the pressurised fluid is thus forced into the space to expand the expandable sleeve 7.

One or both connection parts 12 may be sliding in relation to the tubular part 6, and the other may be fixedly connected with the tubular part 6. The sliding connection part 12 has sealing elements 60. Annular barriers 1 may also be arranged to provide a seal between two tubular structures 3, such as an intermediate casing 18 and a production casing 31, instead of another kind of packer 40.

The annular barrier 1 further comprises a shut-off valve 14 arranged in the aperture 11. The shut-off valve has an open and a closed position. When in the open position, fluid is let into the space 13, and when in the closed position, the fluid can no longer pass through the valve 14 into the space 13. By having a shut-off valve 14, the aperture 11 of the tubular part 6 of the annular barrier 1 can be closed when the expandable sleeve 7 has been expanded into a contact position, as shown in FIG. 1.

Figure 2:
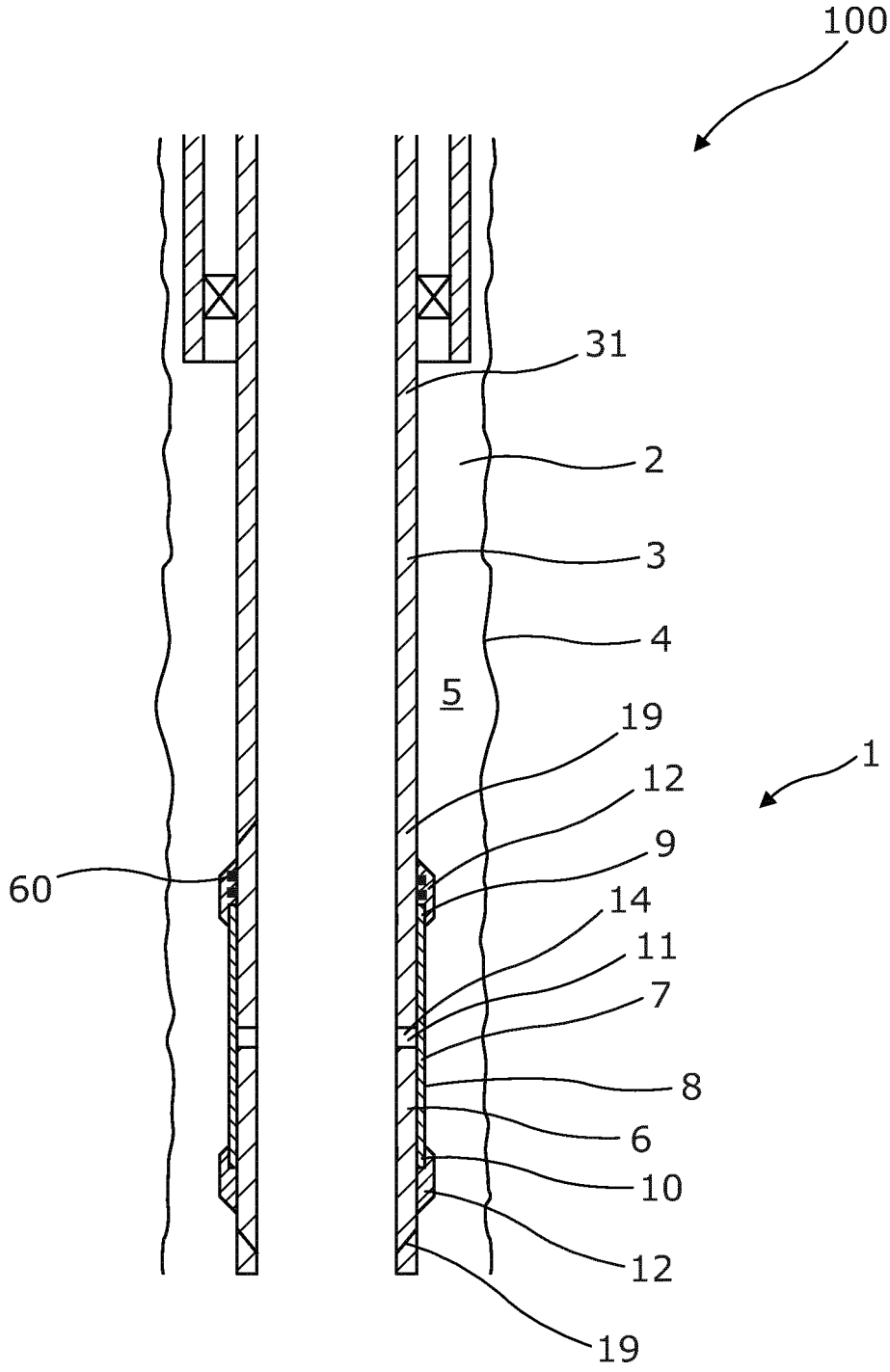
FIG. 2 shows the annular barrier of FIG. 1 in an unexpanded condition.

In FIG. 2, the annular barrier 1 is shown before being expanded. To expand one or more annular barriers, the tubular structure 3 is pressurised by injection of a fluid. As shown in FIGS. 3*a*-3*d*, to be capable of detecting when the expandable sleeve 7 has been expanded into a contact position, as shown in FIG. 1, the annular barrier 1 comprises a detection device 20 monitoring the expansion process. The detection device 20 is adapted to activate the shut-off valve 14 to bring the shut-off valve 14 from the open position to the closed position when detecting that the expandable sleeve 7 has been expanded into a contact position.

Thus, the detection device 20 shown in FIGS. 3*a*-3*d* comprises a movement sensor 21 for detection of the movement of the sliding sleeve or the movement of the expandable sleeve 7. The movement sensor 21 detects a movement of the sleeve 7 or the sliding connection part 12 which initiates the detection of a stop of the movement again and the contact position, in which contact between the outer face 8 of the expandable sleeve 7 and the inner wall of the borehole has been reached. In the contact position, the expandable sleeve 7 is prevented from further radial expansion, and thus, the movement of the sliding connection part 12 and the sleeve 7 stops.

In one embodiment, the detection device 20 comprises a movement sensor 21 for detecting movement of one or both of the connection parts 12 being slidable in relation to the tubular part 6.

Figure 3A:
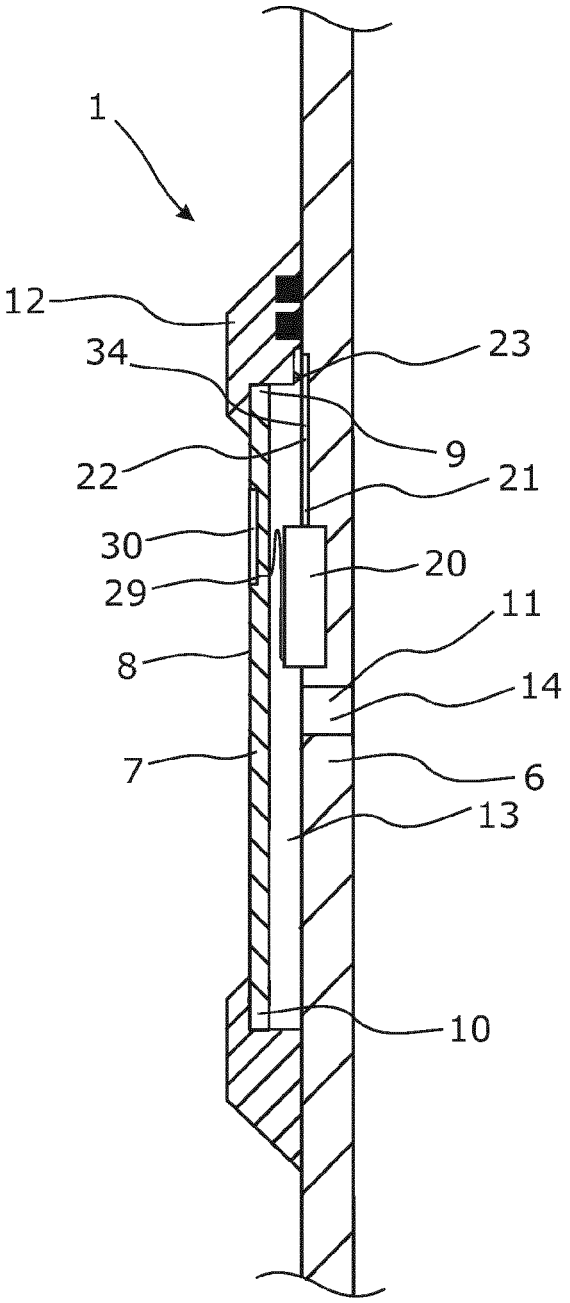
FIGS. 3*a*-3*d* illustrate different annular barriers comprising a detection device for detecting when the expandable sleeve has been expanded into a contact position.

In the embodiment shown in FIG. 3*a*, the movement sensor 21 is a linear potentiometer 34 measuring the position of the sliding connection part 12 in the longitudinal direction along the tubular part 6. The linear potentiometer 34 comprises a resistive element 22 and a wiper device 23 displaceable in the longitudinal direction of the resistive element 22. The linear potentiometer may be a linear membrane potentiometer of the kind available from the company Spectra Symbols. As shown in FIG. 3*a*, the wiper device 23 is arranged on one of the connection parts 12 being slidable in relation to the tubular part 6. The wiper device 23 abuts the resistive element 22 and by measuring the electrical output, e.g. voltage, from the resistive element 22, it is possible to determine the exact position of the wiper device 23 along the resistive element 22.

Figure 3B:
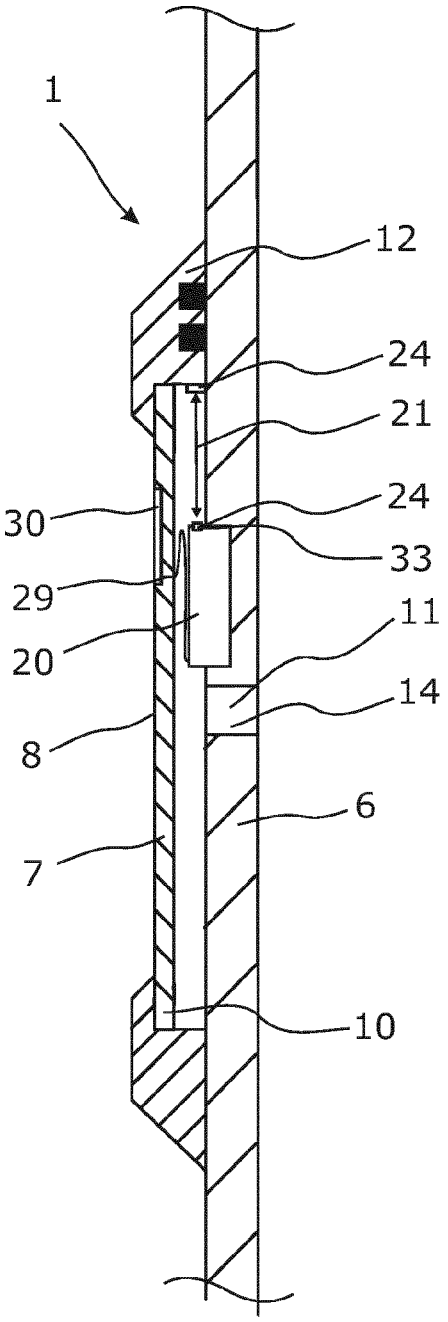

As shown in FIG. 3*b*, the movement sensor 21 may alternatively be a distance sensor 24 measuring the distance between the slidable connection part 12 and a predetermined position 33 along the tubular part 6. The distance sensor 24 may incorporate a laser or any other means known to the skilled person suitable for measuring the distance between the slidable connection part 12 and the predetermined position 33. By continuously measuring the distance, it is possible to determine the position of the slidable connection part and to determine whether the connection part moves.

Figure 3C:
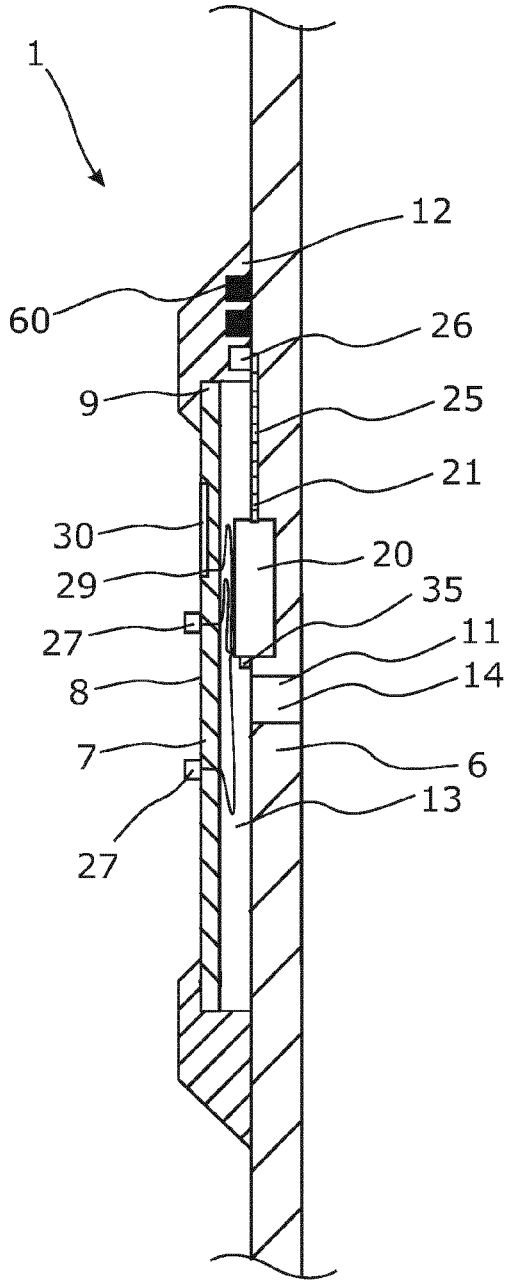

As shown in FIG. 3*c*, the movement sensor 21 may also be a variable reluctance sensor, such as an inductive magnetic sensor 26, for measuring the position of the slidable connection part 12 in the longitudinal direction along the tubular part 6. The inductive magnetic sensor detects a plurality of magnetic elements 25 incorporated in the outer surface of the tubular part. To detect movement of the slidable connection part, the frequency of detection of the magnetic element may be monitored. Alternatively, the number of magnetic elements may be detected to determine the position of the connection element.

The movement sensor 21 may also comprise a tracking wheel (not shown) arranged on the slidable connection part and driving on the outer surface of the tubular part. By detecting rotation of the tracking wheel, it is possible to determine whether the slidable connection part moves. The number of revolutions may also be used to determine the position of the slidable connection part 12.

The movement sensor 21 continuously detects whether the slidable connection part is moving and possibly also recording the position in the longitudinal direction to determine the total displacement of the slidable connection part 12. Thus, the movement sensor 21 may be used to determine when the slidable connection part 12 has stopped moving. Output from the movement sensor 21 is used by the detection device 20 to determine when the expandable sleeve 7 has been expanded into a contact position and the shut-off valve 14 should be activated to block the flow of fluid into the space 13.

In another embodiment, the detection device 20 comprises an expansion sensor 29 for detecting a material expansion of the expandable sleeve 7. The expansion sensor 29 may comprise a strain gauge 30, or any other means suitable for measuring material expansion, provided at an outer face 8 of the expandable sleeve 7.

In a further embodiment, the detection device comprises both a movement sensor 21 and an expansion sensor 29 according to the above described.

Figure 3D:
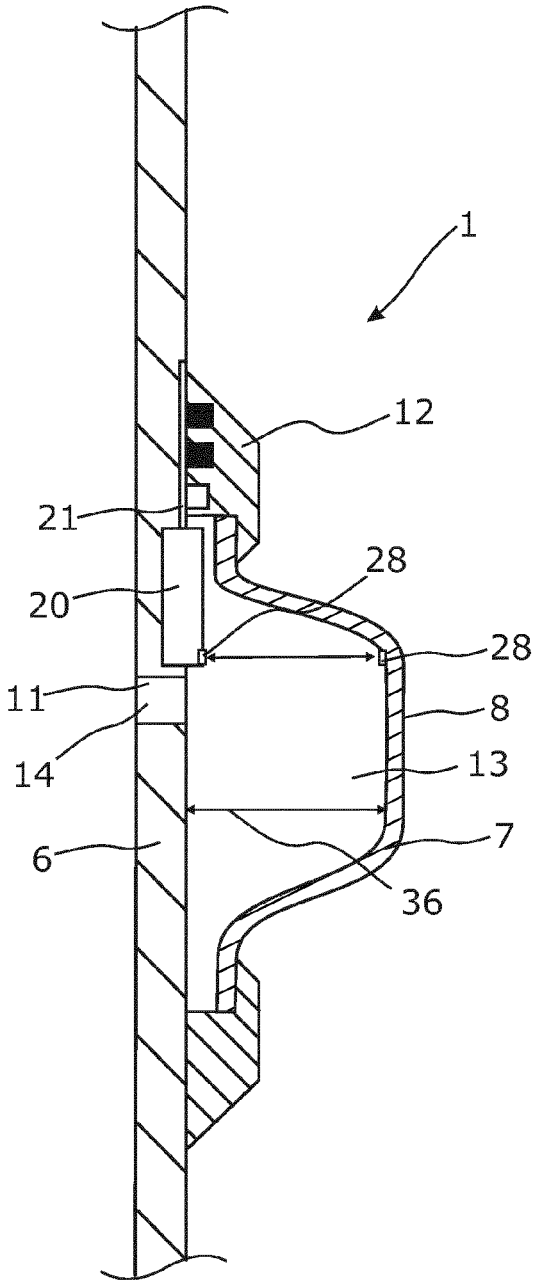

Embodiments of the detection device may also incorporate various other sensors capable of determining when the expandable sleeve 7 has been expanded into a contact position. As shown in FIG. 3*c*, the annular barrier 1 comprises one or more contact pressure sensors 27 arranged at the outer face 8 of the expandable sleeve 7. The pressure sensors 27 measure the contact pressure between the outer surface 8 of the expandable sleeve 7 and the inner wall of the borehole when the annular barrier is expanded downhole, as shown in FIG. 1. As shown in FIG. 3*d*, the detection device 20 may also comprise a distance sensor 28 adapted to measure an inner diameter 36 of the expanded sleeve. Further, a fluid pressure sensor 35 may be provided to measure the pressure inside the space 13 as shown in FIG. 3*c*.

The detection device 20 may rely on one or more detected parameters, such as the movement of the slidable connection part, the material expansion of the expandable sleeve, the inner diameter 36 of the expanded sleeve 7 and/or the contact pressure or the pressure inside the expandable sleeve to determine when the expandable sleeve has been expanded into a contact position.

When one or more expandable sleeves 7 is/are to be expanded by pressurising the tubular structure from within, the detection device 20 detects when the sliding connection part stops, i.e. when the contact position is reached and/or when the material of the expandable sleeve is no longer expanding when the contact position is reached. When the sliding connection part 12 has stopped and/or when the material of the expandable sleeve is no longer expanding, the detection device 20 may determine that the expandable sleeve 7 has been sufficiently expanded to provide a sufficient contact between the outer face 8 of the expandable sleeve 7 and the inner wall of the borehole and thus into the contact position. The detection device 20 may also detect the pressure in the space 13 and await a certain increase in the pressure before determining that the expandable sleeve has been sufficiently expanded.

When the detection device 20 determines that the expandable sleeve 7 has been sufficiently expanded, meaning that the contact position has been reached, the detection device 20 causes the shut-off valve 14 to close to prevent further pressure being built up inside the space 13 as the pressure in the well is increased to expand other annular barriers requiring a higher expansion pressure. In one embodiment, the shut-off valve 14 is a solenoid valve that is closed by discontinuing the power required to keep the valve open. Thus, when the expandable sleeve 7 has been sufficiently expanded, power to the solenoid valve is discontinued, whereby the valve 14 closes and the space 13 is sealed. If, for some reason, it is required that the shut-off valve is reopened, e.g. to equalise the pressure between the borehole and the space 13 inside the expanded sleeve, this may be done by resuming the supply of power to the solenoid valve. Equalisation of the pressure may be required in connection with injection, stimulation or fracture operations.

The detection device may further comprise a timer for closing the shut-off valve 14 after a predetermined period of time subsequent to the detection of the expandable sleeve 7 being in the contact position in which the sleeve and the sliding connection part are prevented from further movement. By having a timer, the closing of the valve may occur at a certain delay in order to make sure that the sleeve 7 is fully expanded and so that the valve 14 is not closed too early.

The detection device 20 may further comprise a seismic sensor or another kind of acoustic sensor for detection of the sound at the aperture 11 in order to detect any sound changes during expansion. Fluid flowing into the space 13 makes a certain sound, and when the contact position is reached and the expansion process makes an intermediate stop before continuing and cracking the formation undesirably, the fluid no longer flows into the space 13, and the sound is therefore decreased accordingly, indicating that the contact position is reached.

Figure 4:
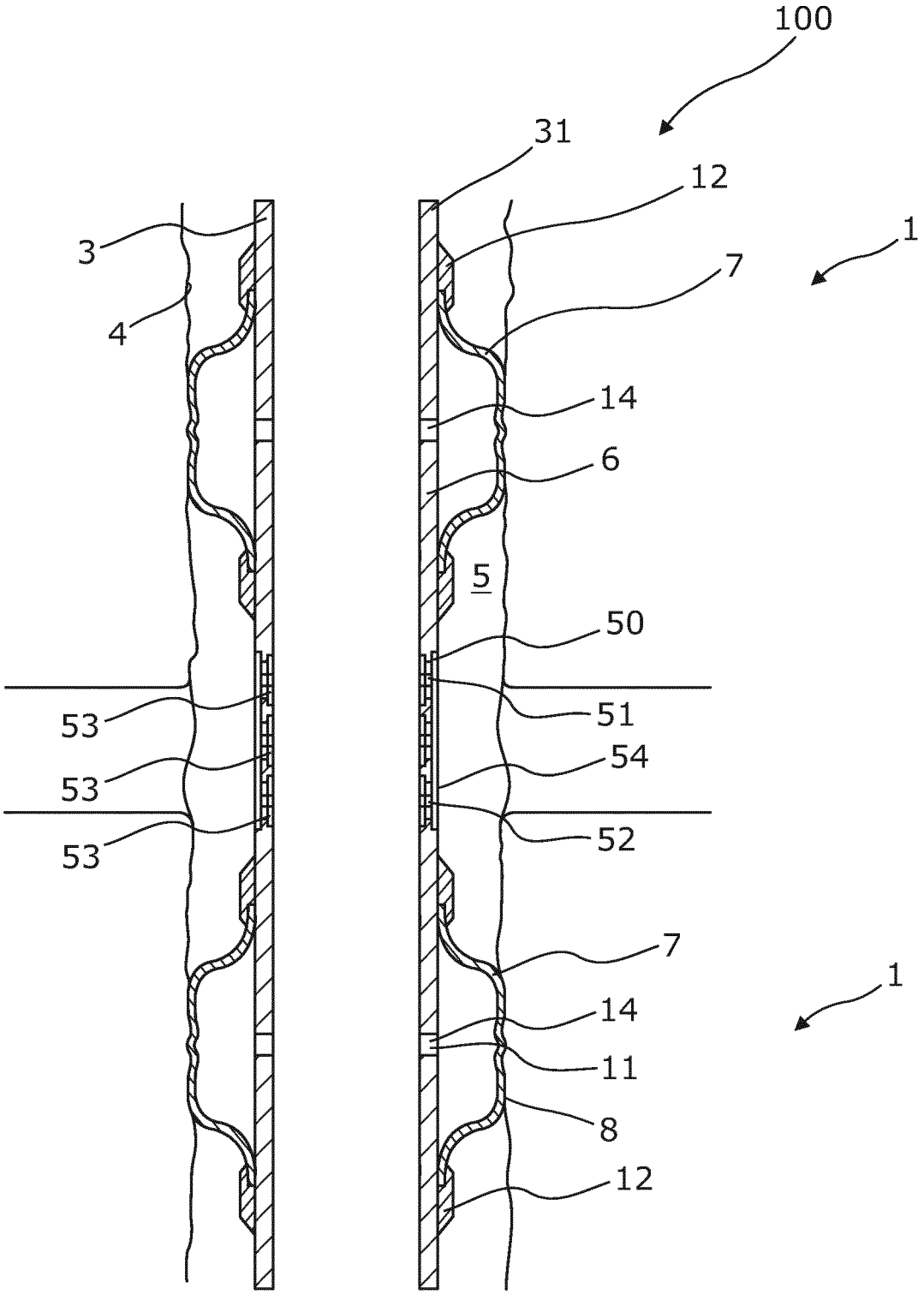
FIG. 4 shows a downhole system having a plurality of annular barriers.

The invention further relates to a downhole system 100 comprising a plurality of annular barriers 1 according to the above described and as shown in FIG. 4. The downhole system 100 comprises a well tubular structure 3 having a valve section 50 arranged between two annular barriers for letting hydrocarbon-containing fluid into the well tubular structure 3 and up through the production casing 31. The valve section 50 has inflow control valves 51 and a fracturing opening or a fracturing valve 52. A screen 54 may be arranged opposite the valves in a recess on the outer face of the well tubular structure 3. Opposite the valve 14, a plurality of sliding or rotational sleeves 53 are arranged to close off the valve while the well tubular structure 3 is being pressurised.

By contact position is meant the position of the expanded sleeve in which a contact between the outer face 8 of the expandable sleeve 7 and the inner wall 4 of the borehole is reached so that the annular barrier has provided an isolation of one part of the annulus from another part of the annulus.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing is meant any kind of pipe, tubing, tubular, liner, string, etc. used downhole in relation to oil or natural gas production.

In the event that the tools are not submergible all the way into the casing, a downhole tractor can be used to push the tools all the way into position in the well. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. An annular barrier to be expanded in an annulus between a well tubular structure and an inside wall of a borehole downhole, comprising:

a tubular part for mounting as part of the well tubular structure, said tubular part having a longitudinal axis, an inflatable, expandable sleeve surrounding the tubular part and having an outer face positioned to contact the inside wall, the expandable sleeve being of metallic construction and the outer face having no apertures, each end of the expandable sleeve being fastened to the tubular part by means of a connection part, where at least one of the connection parts is a sliding connection part sliding in relation to the tubular part when the expandable sleeve is expanded, an annular barrier space between the tubular part and the expandable sleeve, an aperture in the tubular part for letting fluid into the annular barrier space to expand the sleeve, and an activatable shut-off valve having an open and a closed position and arranged in the aperture, wherein the annular barrier further comprises a detection device for detecting when the expandable sleeve has been expanded into a contact position in which the outer face of the sleeve contacts the inside wall, and wherein the detection device is adapted to provide a signal to activate the shut-off valve to bring the shut-off valve from the open to the closed position when detecting that the expandable sleeve is in the contact position.

2. An annular barrier according to claim 1, wherein the detection device comprises a movement sensor for detecting movement of the sliding connection part, and wherein the detection device is adapted to provide a signal to activate the shut-off valve to bring the shut-off valve from the open to the closed position when the movement sensor detects that the sliding connection part has stopped.

3. An annular barrier according to claim 2, wherein the movement sensor comprises a linear potentiometer for detecting a change in the position of the sliding connection part.

4. An annular barrier according to claim 1, wherein the detection device comprises an expansion sensor for detecting a material expansion of the expandable sleeve, wherein the detection device is adapted to provide a signal to activate the shut-off valve to bring the shut-off valve from the open to the closed position when the expansion sensor detects that the material expansion of the expandable sleeve has stopped.

5. An annular barrier according to claim 4, wherein the expansion sensor comprises a strain gauge for detecting expansion of the material of the expandable sleeve.

6. An annular barrier according to claim 2, wherein the movement sensor is a magnet sensor, an accelerometer, an infrared sensor, a variable reluctance sensor or an inductive magnetic sensor for detecting movement of the sliding connection part.

7. An annular barrier according to claim 1, wherein the activatable shut-off valve is a solenoid valve adapted to block the flow of fluid into the annular barrier space when power to the soleniod valve is discontinued.

8. An annular barrier according to claim 1, wherein the detection device comprises a contact pressure sensor provided at the outer surface of the expandable sleeve, the pressure sensor being adapted to measure a contact force between the outer surface of the expandable sleeve and an inner wall of the borehole.

9. An annular barrier according to claim 1, wherein the detection device comprises a fluid pressure sensor for measuring the fluid pressure inside the annular barrier space.

10. An annular barrier according to claim 1, wherein the detection device further comprises a distance sensor for measuring a change in a maximum inner diameter of the expandable sleeve.

11. A downhole system comprising a plurality of annular barriers according to claim 1.

12. A method for expanding an annular barrier according to claim 1, comprising the steps of:

positioning the annular barrier downhole as part of a well tubular structure, pressurising the tubular structure from within to expand the expandable sleeve of the annular barrier, and detecting when the expandable sleeve has been expanded into a contact position.

13. A method according to claim 12, further comprising the step of activating the shut-off valve to block the flow of fluid into the annular barrier space when the expandable sleeve has been expanded into a contact position.

14. A method according to claim 12, wherein a contact pressure between the outer surface of the expandable sleeve and the inner wall of the borehole is measured to detect when the expandable sleeve has been expanded into a contact position.

15. A method according to claim 14, wherein the shut-off valve is activated when the contact pressure between the outer surface of the expandable sleeve and the inner wall of the borehole is in the range of 1,000 psi-2,000 psi.

* * * * *